US007650821B2

(12) United States Patent
Gauthier et al.

(10) Patent No.: US 7,650,821 B2
(45) Date of Patent: Jan. 26, 2010

(54) TORQUE-LIMITING MECHANISM

(75) Inventors: Michael T. Gauthier, Grafton, WI (US); Steven S. Landowski, Random Lake, WI (US)

(73) Assignee: Gauthier Biomedical Inc., Grafton, WI (US)

( * ) Notice: Subject to any disclaimer, the term of this patent is extended or adjusted under 35 U.S.C. 154(b) by 11 days.

(21) Appl. No.: 11/474,242

(22) Filed: Jun. 23, 2006

(65) Prior Publication Data

US 2006/0278051 A1 Dec. 14, 2006

Related U.S. Application Data

(63) Continuation-in-part of application No. 11/153,286, filed on Jun. 15, 2005, now Pat. No. 7,272,998.

(60) Provisional application No. 60/580,160, filed on Jun. 16, 2004.

(51) Int. Cl.
*B25B 23/157* (2006.01)

(52) U.S. Cl. ..... 81/473; 81/52; 81/467; 81/476

(58) Field of Classification Search ..... 81/52, 81/467, 473, 476
See application file for complete search history.

(56) References Cited

U.S. PATENT DOCUMENTS 2,732,746 A * 1/1956 Livermont ..... 81/474
3,167,936 A * 2/1965 Engquist ..... 464/36
4,901,610 A * 2/1990 Larson et al. ..... 81/473
5,881,613 A * 3/1999 Han ..... 81/429
6,132,435 A 10/2000 Young
7,013,769 B2 * 3/2006 Chen ..... 81/473
7,197,968 B2 * 4/2007 Bubel ..... 81/475

* cited by examiner

*Primary Examiner*—Joseph J Hail, III
*Assistant Examiner*—Shantese McDonald
(74) *Attorney, Agent, or Firm*—Boyle Fredrickson S.C.

(57) ABSTRACT

A torque-limiting mechanism is provided for use in a variety of torque-applying tools. The mechanism includes a handle defining a housing in which are disposed a slip gear and a fixed gear. The fixed gear is attached to the housing while the slip gear is attached to drive body extending outwardly from the housing and engageable with an item to be turned utilizing the tool. The slip gear and the fixed gear are connected by teeth disposed on each gear and by ball bearings disposed within recesses located on each gear that are pressed into the recesses by a force exerted on the gears by a number of spring members disposed between an enclosed end of the housing and the fixed gear. The amount of force exerted by the springs on the gears can be varied as necessary, thereby allowing the amount of torque required to enable the slip gear to move with respect to the fixed gear to be set where desired. The use of the ball bearings as the engagement members between the fixed gear and the slip gear provides a smooth transition between positions when the slip gear rotates with respect to the fixed gear, and greatly reduces the amount of friction forces acting on the torque-limiting mechanism, such that the force controlling the operation of the mechanism is solely provided by the springs and easily predictable and controllable. Further, the teeth, due to the angled locking surfaces formed in the teeth, enable the gears to only rotate with respect to one another in one direction.

14 Claims, 8 Drawing Sheets

202
203b
203a
201
222
218
220
230
244
238
248
234
206
204
212
208
210
214
216
218
232
290

3
3
208
214
202

208
204
214
200
234
202

100
101
104
106
105

101
104
106
105
102

TORQUE-LIMITING MECHANISM

CROSS REFERENCE TO RELATED APPLICATIONS

This application is a continuation-in-part of U.S. application Ser. No. 11/153,286 filed on Jun. 15, 2005 now U.S. Pat. No. 7,272,998, which claims priority from U.S. provisional application Ser. No. 60/580,160 filed on Jun. 16, 2004, and each is incorporated herein by reference in its entirety.

FIELD OF THE INVENTION

The present invention relates to tools used to rotate and/or drive fasteners, and more specifically to a torque-limiting mechanism for use with these types of tools.

BACKGROUND OF THE INVENTION

With regard to hard-held and powered tools used to drive features into or out of an item, especially those used in medical applications, there are several common problems associated with tools incorporating existing torque-limiting devices. These problems include loss of consistent torque value after repeated autoclave sterilization cycles, internal components breaking due to high forces and loads on internal cams and gears, inconsistent torque values due to wear on internal components, a strong recoil or snap when set at higher torque values, and difficulty in servicing the mechanism.

More particularly, as shown in FIGS. 20 and 21, in prior art torque-limiting devices, the devices include gears 100, 101 including a number of generally angular teeth 102 disposed along one side of the gears 100, 101. Each tooth 102 includes an angled sliding surface 104 and a flat, vertical locking surface 106 located between the sliding surfaces 104 of adjacent teeth 102. These gears 100, 101 are positioned in the mechanism with the teeth 102 facing one another in a manner where one of the gears 100 can rotate with respect to the other gear 101. This is due to the construction of the mechanism in which one gear 100 is fixed to mechanism and the other gear 101 can move with a drive body (not shown) for the tool to provide the torque-limiting function. When the tool incorporating the gears 100, 101 is subjected to a torquing force greater than a preset maximum, the moveable gear 101 rotates with respect to the fixed gear 100, such that the sliding surfaces 104 of the opposed teeth 102 slide against one another and urge the fixed gear 100 against a spring member (not shown) that biases the gears 100, 101 towards one another. The movable gear 101 can continue to rotate in response to the excessive torque until the flat locking surface 106 on the opposed teeth 102 are moved past the edges 105 of the sliding surfaces 104. In this position the gears 100, 101 move or snap back towards one another due to the bias of the spring member, and the respective flat surfaces 106 come into contact with one another to secure the gears 100, 101 in a camming position.

In order to enable the prior art mechanism to provide a closely controllable amount of torque resistance, the mechanism requires that the forces biasing the gears 100, 101 towards one another from: 1) the spring member; 2) the surface friction provided by the contact of the angled surfaces 104 on the opposed teeth 102 sliding with respect to one another; and 3) the drag of the gears 100, 101 on a housing (not shown) for the mechanism all be known and properly maintained. To enable the surface friction and drag to be controlled, a proper amount of lubrication is required to be present both on the teeth 102 and on the back of the rotatable gear 101 in contact with the housing in order to maintain the constant drag forces on the angled surfaces 104 and the movable gear 101. However, due to the cleaning and/or sterilization of tools including devices of this type, each sterilization cycle causes an inherent loss of the lubrication in the mechanism. As a result, the amount of surface friction and drag between the gears 100, 101 changes over time. This in turn drives the torque values up such that a consistent amount of torque resistance is not provided by the device.

Further, as a result of the particular shape of the teeth 102 on each gear 100, 101 the rotation of the gear 101 results in the locking surfaces 106 on each gears 100, 101 "snapping" into engagement with one another in both the axial and circumferential directions after passing one another. This movement of the locking surfaces 106 into engagement with one another necessarily creates vibrations in the mechanism which are transmitted through the mechanism and the tool incorporating the mechanism to the fastener and/or the person on which the device is being utilized. In many situations, these vibrations are highly undesirable. Also, the stress exerted on the surfaces 106 as they strike one another also leads to fracturing or chipping of the teeth 102, lessening the useful life of the mechanism. When the teeth 102 are chipped, this additional material can also collect on the sliding surfaces 104 of the teeth 102, thereby causing even more inconsistent torque values for the mechanism.

In addition, prior art torque limiting devices include one piece calibration nuts (not shown) that engage the spring members of the mechanism to calibrate or set the amount of torque necessary to rotate the gears 100, 101 with respect to one another. The calibration nut is normally secured to the mechanism by adhesives, by pairs of jam or locking nuts to reduce space and/or a mechanical interruption of threads to which the calibration nut is mounted. The design of each of these prior art calibration nut assemblies increases the complexity of the overall mechanism, and provides an additional manner in which the mechanism can break down.

Due to the multitude of problems associated with prior art torque limiting devices, it is desirable to develop or design a torque-limiting device which greatly reduces each of the problems associated with prior art devices at this time.

SUMMARY OF THE INVENTION

According to a primary aspect of the present invention, a torque-limiting device for use in hand-held and power tools is provided in which the torque-limiting device includes a number of rolling ball bearings disposed partially within opposed pairs of recesses located in a pair of opposed gears that, in conjunction with springs acting on the gears and ball bearings, are utilized to control the movement and resistance to movement of the mechanism. The recesses in one of the gears are connected by a raceway along which the bearings can move between recesses when the mechanism is in operation. The use of the ball bearings and a raceway on one of the gears that the ball bearings can move along between the recesses enables the mechanism to be operated in a manner that greatly reduces the amount of variation over time of the preset torque values for the mechanism by reducing the wear experienced by the internal components controlling the actuating of the mechanism, and by avoiding the significant recoil or snap experienced by prior art mechanisms. This construction also greatly reduces the effects of varying levels of friction present in prior art mechanism by using ball bearings as the main friction generating members in the mechanism. The shape of the bearings creates much less overall friction, as well as a relatively constant amount of friction over extended periods of use of the mechanism, without the need for significant amounts of lubricants within the mechanism.

According to another aspect of the present invention, the ability of the mechanism to provide consistent torque values is also enhanced by the use of a split locking calibration nut that is securable to the mechanism in a simple manner, thereby avoiding the previous issues concerning the shifting of the nut and the consequent variation of the torque value applied by the mechanism. The calibration nut is threadedly engaged with a housing for the tool and with single locking nut that selectively positions the calibration nut within the housing to provide the desired amount of force against the springs that are used to determine the maximum torque level at which the mechanism will operate. By varying the position of the calibration nut, the amount of torque at which the mechanism slips can be set as desired, while the locking nut can maintain position of the calibration nut at this desired value. In addition to using a locking nut to hold the calibration nut in position, the calibration nut itself may include protrusions that are urged outwardly into engagement with the housing for the mechanism when the locking nut is engaged within the calibration nut. Thus, the calibration nut can be easily adjusted or removed in order to service the mechanism, without the need for disengaging any additional securing means, such as adhesive, or additional lock nuts as used in prior art mechanism.

According to still a further object of the present invention, a mechanism is enclosed within housing having a cover secured to the housing in an easily removable manner. The cover also includes an access cap that can be removed from the cover to enable the mechanism to be serviced without having to completely disassemble the mechanism. Further, the access cap engages the cover in a manner that prevents the cover from being inadvertently disengaged from the housing while the tool including the mechanism is in use.

According to still another aspect of the present invention, the gears can be formed with a number of inter-engaging locking surfaces that assist in enabling the gears to engage one another and provide the resistance to a movement of the mechanism. Each of the gears is formed with relatively shallow, sloped teeth around the periphery of the gear that are capable of mating with the similarly shaped teeth formed on the opposite gear to assist in preventing the rotation of the gears with respect to each other in one direction. However, the depth and slope of the teeth on each of the gears is shallow enough to prevent the "snapping" and vibration problems associated with prior art toothed engaging gears, as discussed previously.

Numerous other advantages, features, and objects of the present invention will remain apparent from the following detailed description taken together with the drawing figures.

BRIEF DESCRIPTION OF THE INVENTION

In the drawings:

The drawings illustrate the best mode currently contemplated of practicing the present invention.

DETAILED DESCRIPTION OF THE INVENTION

Figure 3:
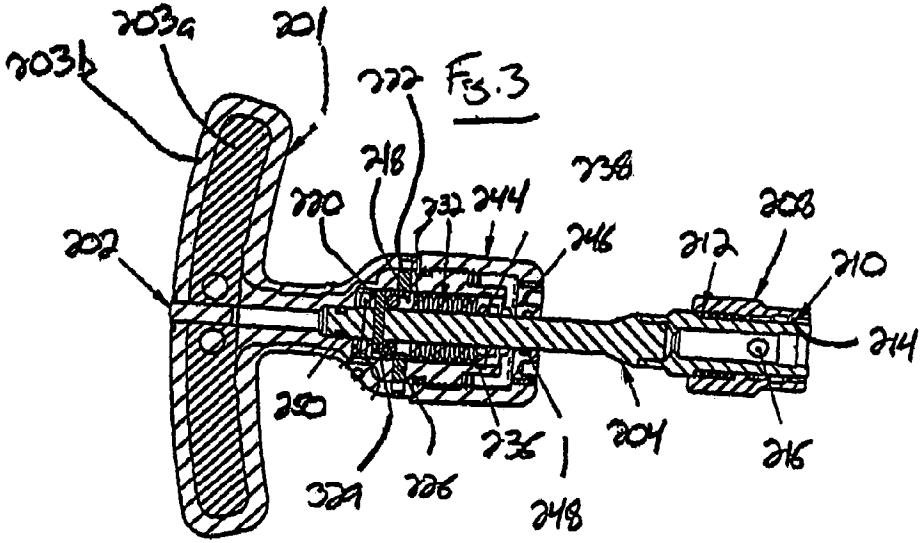
FIG. 3 is a cross-sectional view along line 3-3 of FIG. 2.
Figure 2:
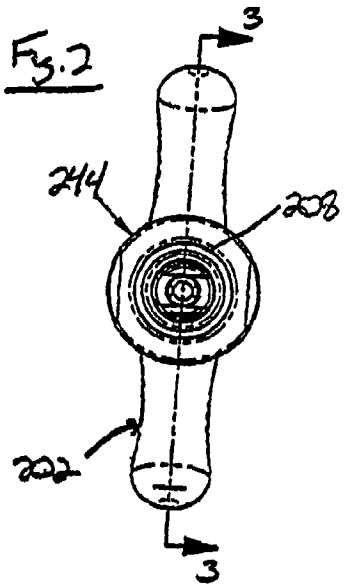
FIG. 2 is an end plan view of the device of FIG. 1.
Figure 1:
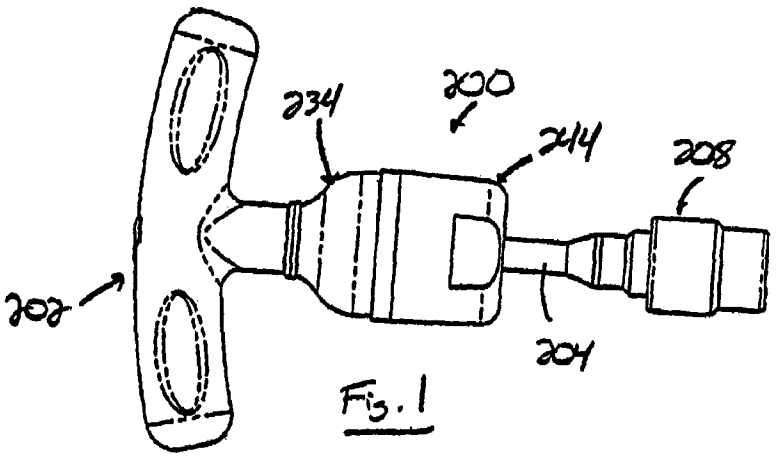
FIG. 1 is a side plan view of a tool including the torque-limiting mechanism constructed according to the present invention.
Figure 20:
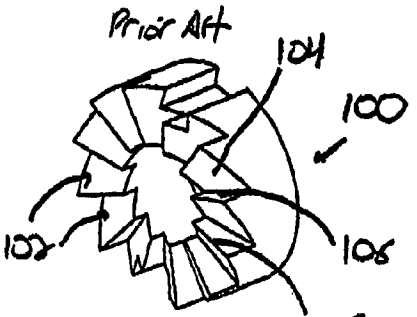
Prior Art Fig. 20
FIG. 20 is an isometric view of a fixed gear used in a prior art torque-limiting mechanism.
Figure 21:
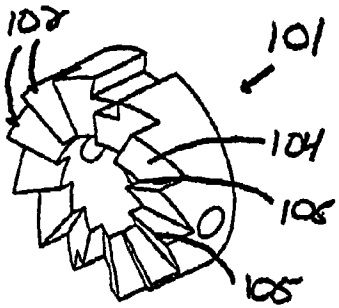
Prior Art Fig. 21
FIG. 21 is an isometric view of a slip gear used with the prior art fixed gear of FIG. 20.
Figure 4:
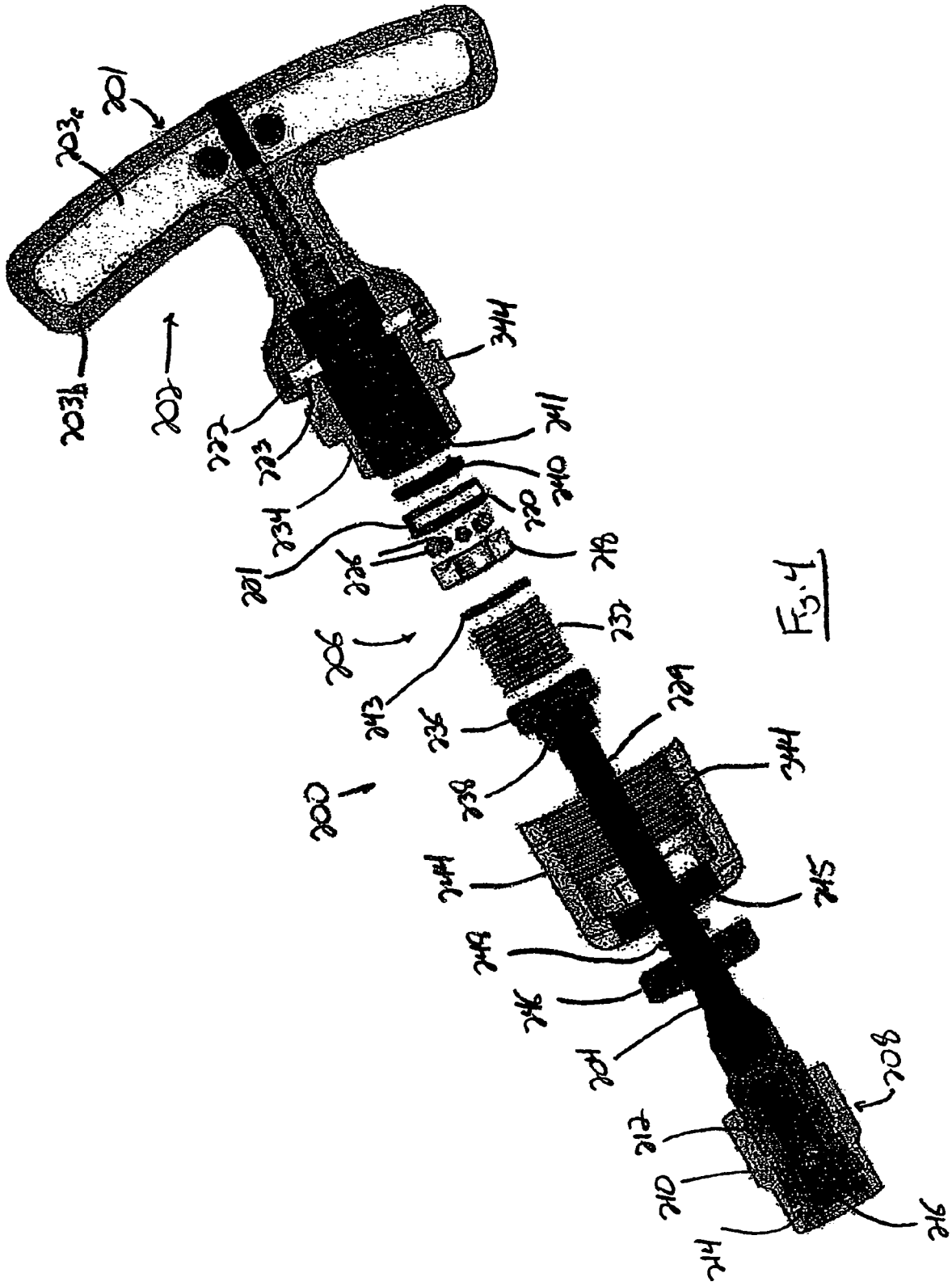
FIG. 4 is an exploded, cross-sectional view of the device of FIG. 1.
Figure 5:
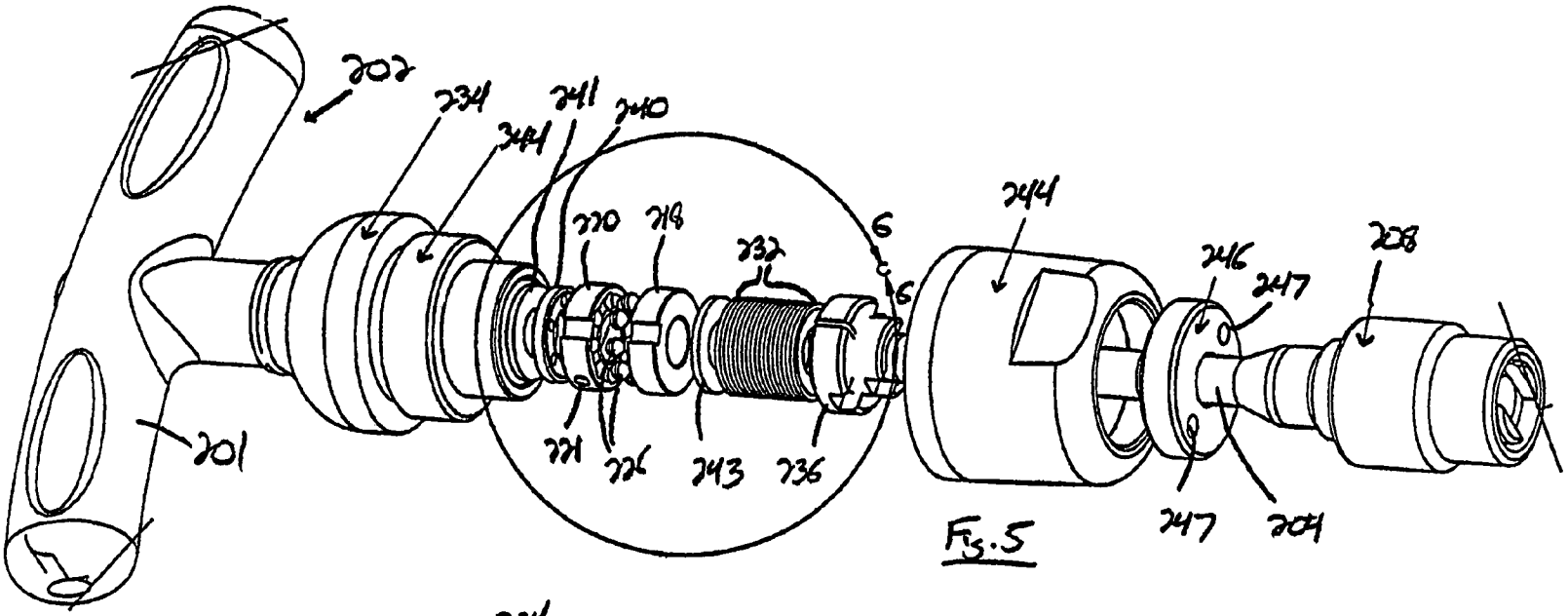
FIG. 5 is an exploded, isometric view of the mechanism of FIG. 1.
Figure 6:
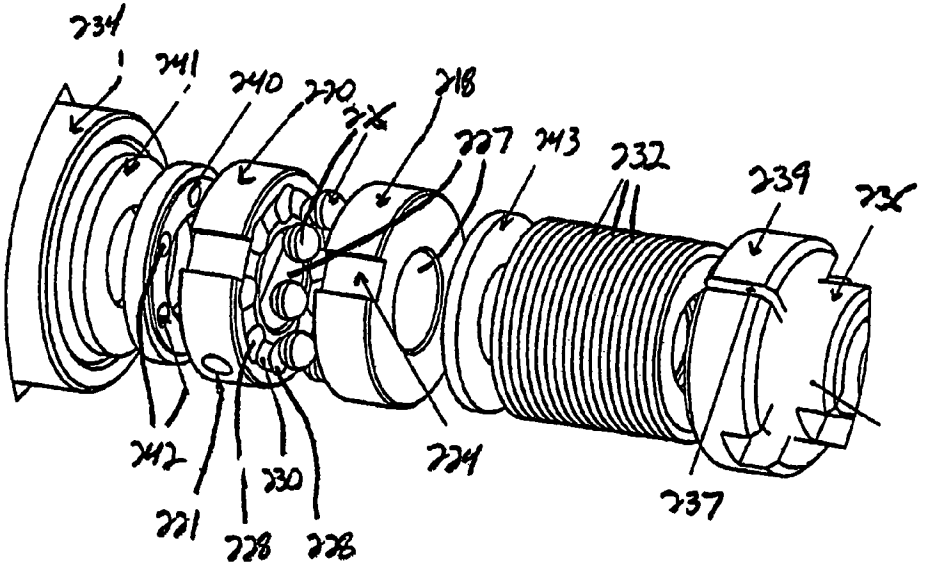
FIG. 6 is a partially broken away, exploded view along line 6-6 of FIG. 5.
Figure 7:
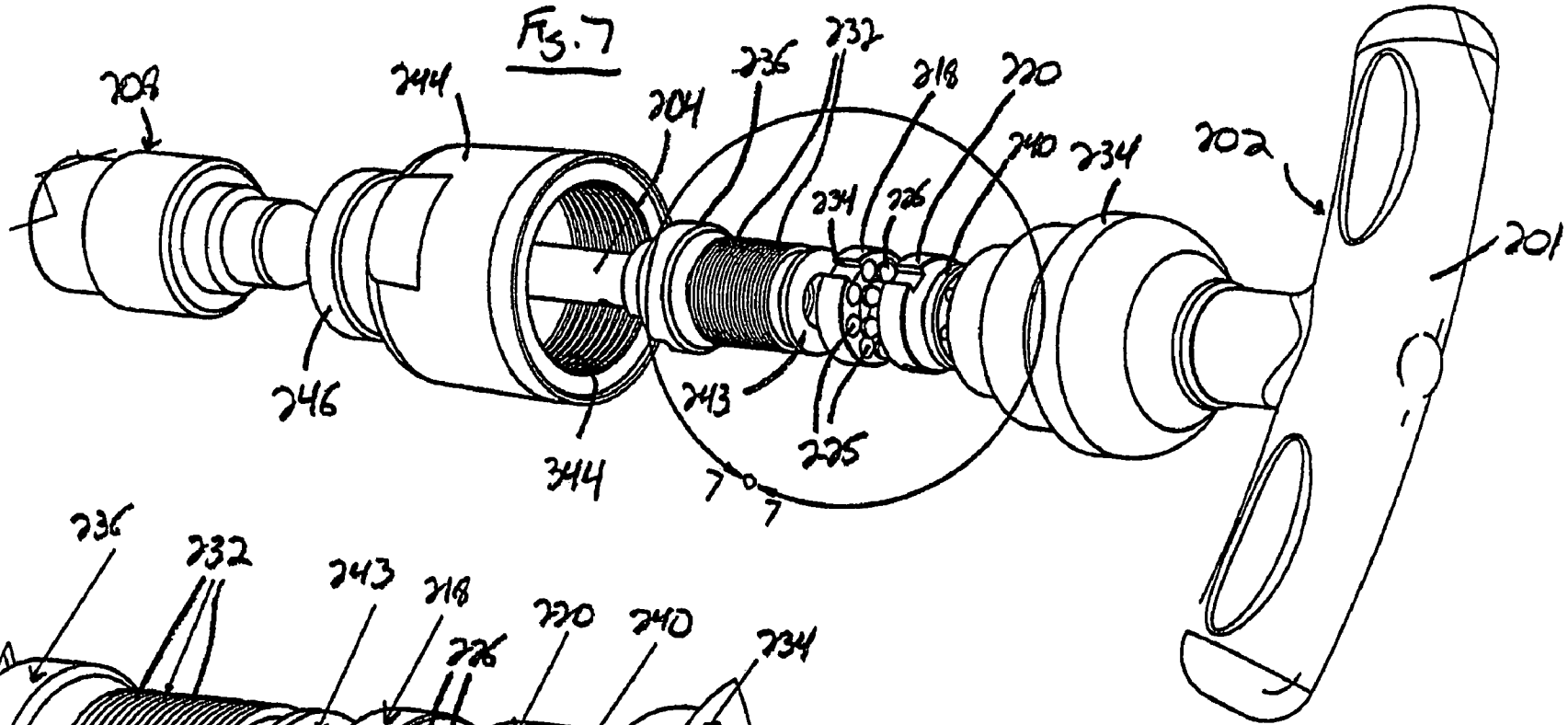
FIG. 7 is an exploded, isometric view of the mechanism of FIG. 5 in a direction opposite FIG. 5.
Figure 8:
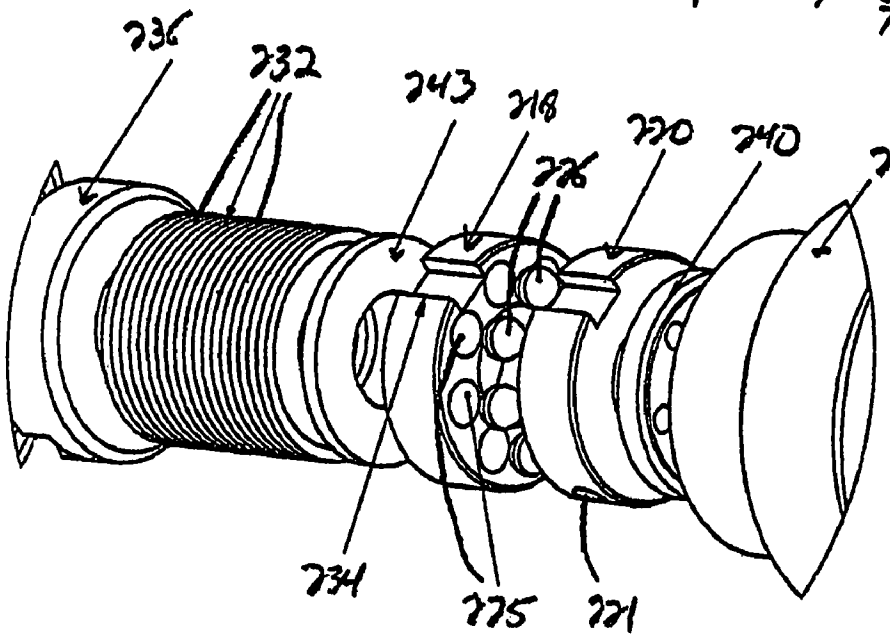
FIG. 8 is a partially broken away, exploded view of the mechanism along line 8-8 of FIG. 7.
Figure 10:
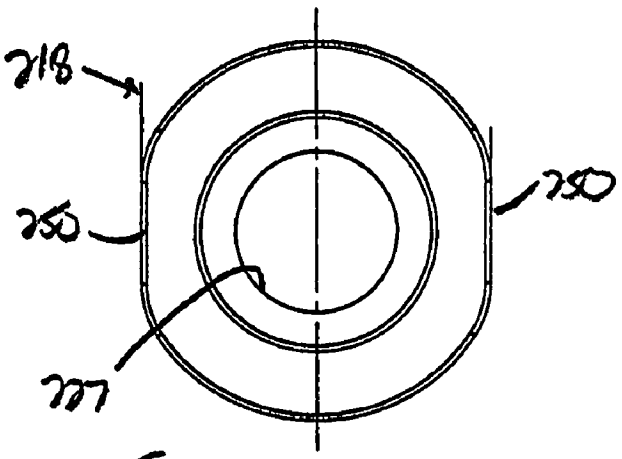
FIG. 10 is a top plan view of the fixed gear of FIG. 9.
Figure 11:
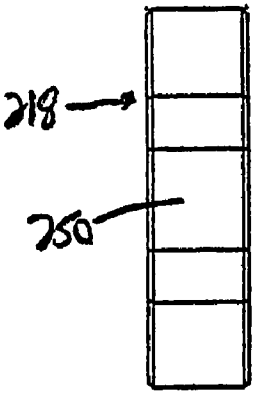
FIG. 11 is a side plan view of the fixed gear of FIG. 9.
Figure 9:
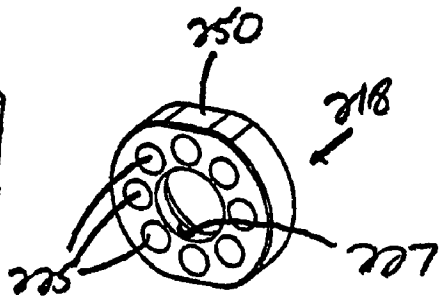
FIG. 9 is an isometric view of a second embodiment of the fixed gear of the mechanism of FIG. 1.
Figure 12:
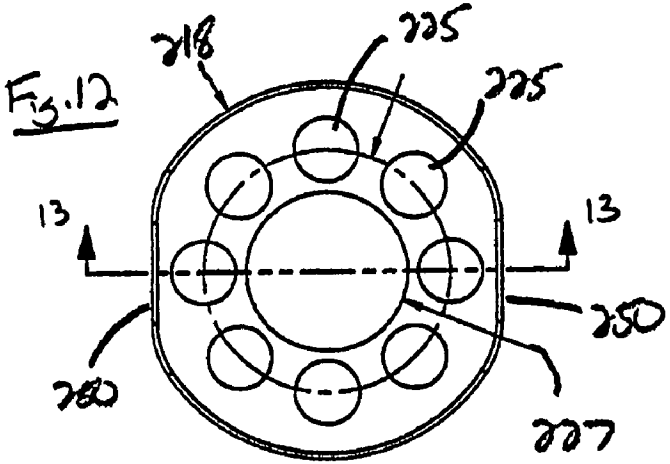
FIG. 12 is a bottom plan view of the fixed gear of FIG. 9.
Figure 13:
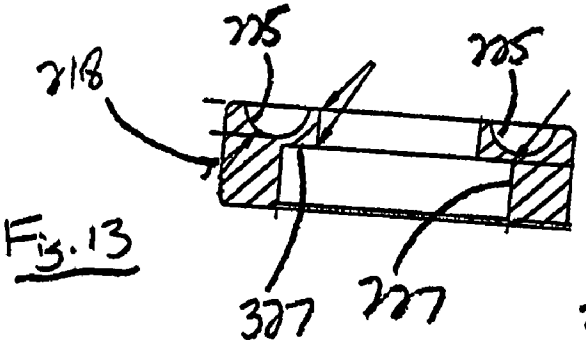
FIG. 13 is a cross-sectional view along line 13-13 of FIG. 12.
Figure 15:
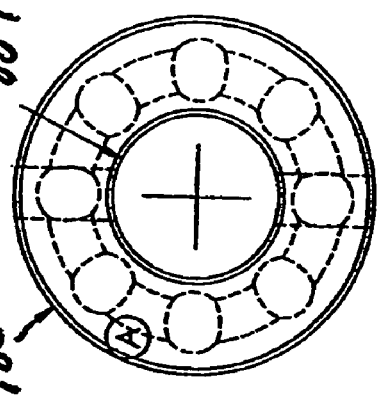
FIG. 15 is a bottom plan view of the slip gear of FIG. 14.
Figure 16:
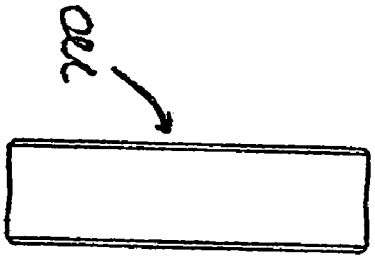
FIG. 16 is a side plan view of the slip gear of FIG. 14.
Figure 19:
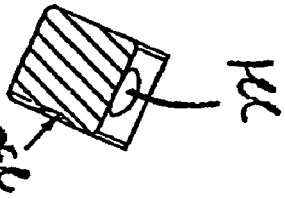
FIG. 19 is a cross-sectional view along line 19-19 of FIG. 17.
Figure 17:
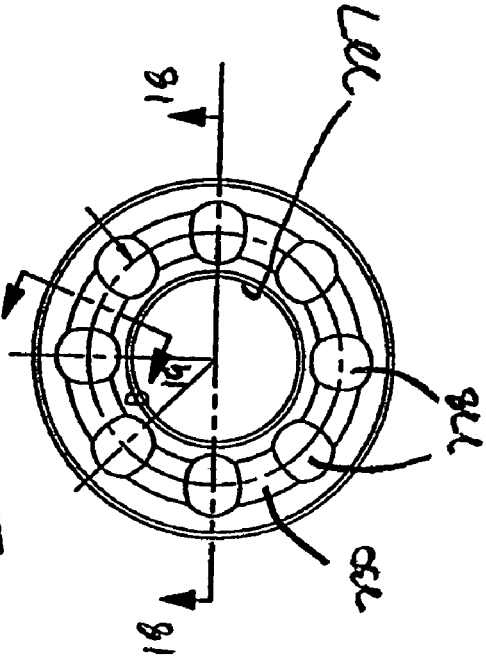
FIG. 17 is a top plan view of the slip gear of FIG. 14.
Figure 14:
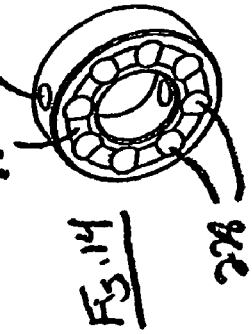
FIG. 14 is an isometric view of the slip gear of the device of FIG. 1.
Figure 18:
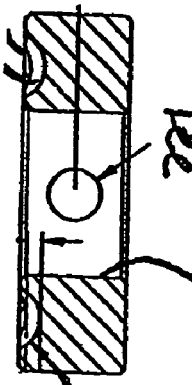
FIG. 18 is a cross-sectional view along line 18-18 of FIG. 17.
Figure 22:
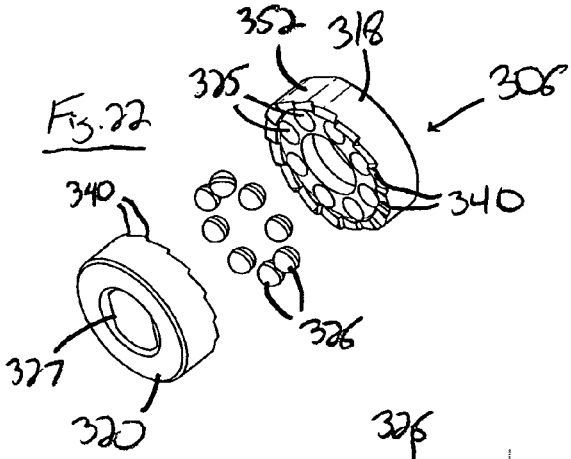
FIG. 22 is an isometric, exploded view of a second embodiment of the torque-limiting mechanism of the present invention.
Figure 24:
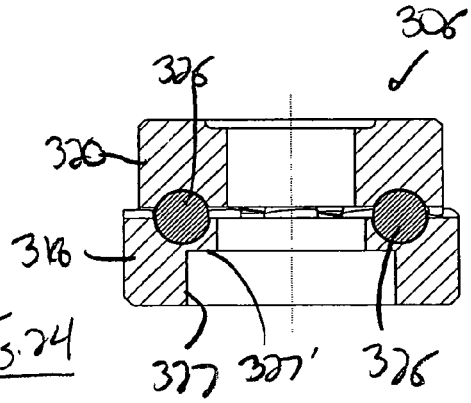
FIG. 24 is a cross-sectional view along line 24-24 of FIG. 23.

With reference now to the drawing figures in which like reference numerals designate like parts throughout the disclosure, a tool including a torque-limiting mechanism constructed according to the present invention is indicated generally at 200 in FIGS. 1-4. The tool 200 can be virtually any type of hand-held or power-driven tool that is used to apply torque to a driven member, e.g., a fastener, but in a preferred embodiment, is a hand-held torque wrench that includes a handle 202 with a gripping part 201 operatively connected to a drive body 204 extending outwardly from the handle 202 by the torque-limiting mechanism 206. The handle 202 is preferably formed of a suitably rigid, but relatively lightweight material, such as a light metal or plastic, to reduce the weight of the tool 200. Also, the handle 202 can be formed to have any desired configuration, and may include on the gripping part 201 an inner portion 203*a* formed of a more rigid material, and an outer portion 203*b* of a more flexible material to increase the ease of use of the tool 200.

The drive body 204 is preferably an elongate member that is used to transfer the torque applied to the tool 200 via the handle 202, or motor (not shown) in power-driven tool embodiments, to the fastener to be rotated, such as a screw, engaged by the drive body 204 opposite the handle 202. The drive body 204 is formed of a generally rigid material, such as a metal or hard plastic, and is preferably circular in cross-section, but can be formed to have other cross-sectional configurations as desired. Opposite the mechanism 206, the drive body 204 supports a connector 208. The connector 208 can have any desired configuration for releasably retaining thereon a suitable fastener-engaging implement (not shown), but in one embodiment best shown in FIGS. 3 and 4, includes a locking collar 210 slidably secured to the exterior of the connector 208 by a spring 212 and retaining ring 214. When the collar 208 is urged against the bias of the spring 212 towards the drive body 204, a retaining ball 216 on the connector 208 is moved out of the interior of the connector 208. This enables the implement to be inserted into the interior of the connector 208 without interference from the retaining ball 216. When the collar 210 is released, allowing the collar 210 on the connector 208 to return to its original position due to the bias of the spring 212, the retaining ball 216 is urged by the collar 210 back into the interior of the connector 208 into engagement with an aligned recess (not shown) in the implement, thereby securing the implement within connector 208.

Referring now to FIGS. 3-19, the torque-limiting mechanism 206 includes a pair of gears 218, 220 formed of a rigid material, such as a metal, or hard plastic that are positioned generally opposite one another within the mechanism 206. The gear 218, best shown in FIGS. 5-8 is a fixed gear secured within a generally cylindrical housing 234 attached to or integrally formed with one end of the handle 202 opposite the gripping part 201. The fixed gear 218 is preferably secured within the housing 234 by a pair of locking pins 222 that extend through the housing 234 into connection with the gear 218. The pins 222 extend through bores 223 in the housing 234 into slots 224 formed on opposite sides of the gear 218 to prevent rotation of the gear 218 within the housing 234. In an alternative embodiment, best shown in FIGS. 9-13, the fixed gear 218 can be formed with a pair of flats 252 on opposite sides of the gear 218 that are engaged with similarly shaped flat surfaces (not shown) located on the interior surface of the housing 234. The flats 252 take the place of the pins 222 and slots 224 to hold the fixed gear 218 in position within the housing 234 to enable the transfer of torque from the handle 202 to the fixed gear 218.

The fixed gear 218 also includes a number of dimples 225 spaced around a central opening 227 in the gear 218 on one surface of the fixed gear 218. The opening 227 can be cylindrical or can define an annular shoulder 327 therein to assist in the formation of the dimples 225. A number of generally spherical ball bearings 226 are disposed partially within the dimples 225 and are able to rotate therein. The depth of the dimples 225 in the gear 218 is preferably sufficient to receive approximately one half of the volume of each bearing 226, such that while the bearings 226 can rotate within the dimples 225, the bearings 226 are each maintained within the dimples 225. In a particularly preferred embodiment, the bearings 226, which are formed of a rigid and smooth material, such as a metal, are formed to have a diameter slightly less than the diameter of the dimples 225. This allows the bearings 226 to rotate more freely within the dimples 225 when the tool 200 and mechanism 206 are in use and also enables the mechanism 206 to be assembled more easily.

The gear 220, i.e., the rotatable or slip gear, is also positioned within the housing 234 immediately adjacent the fixed gear 218 between the fixed gear 218 and the gripping part 201 of the handle 202. The slip gear 220, best shown in FIGS. 5-8 and 14-19, is formed similarly in shape and material to the fixed gear 218, with a central opening 227 and a number of dimples 228 spaced around the opening 227 on one side of the gear 220 that is positioned to face the dimples 225 in the fixed gear 218. The dimples 228 receive the end of each of the bearings 226 extending outwardly from dimples 225 in fixed gear 218, but are less deep than dimples 225 in the fixed gear 218. The slip gear 220 also includes an arcuate raceway 230 extending around the surface of the gear 220 along a circular centerline between the dimples 228. During operation of the mechanism 206, the bearings 226, while retained in dimples 225 on the fixed gear 218, can move along the raceway 230 in order to displace the bearings 226 between the respective dimples 228 as the slip gear 220 rotates with respect to the fixed gear 218 when a torque level above a pre-selected maximum is applied to the tool 200.

Additionally, the slip gear 220 includes a cross pin opening 221 that extends across and through the slip gear 220 generally perpendicular to the central opening 227. The opening 221 is positionable in alignment with a bore 229 formed in the drive body 204 in order to enable a cross pin 329 to be inserted through the opening 221 and bore 229 to secure the slip gear 220 to the drive body 204. Further, while the diameter of the bore 229 and opening 221 within which the pin 329 is received can be formed to closely conform to the outer diameter of the pin 329, in a preferred embodiment, the diameter of the opening 221 and bore 229 are formed to be greater than required for insertion of the pin 329. This gap created between the pin 329 and the opening 221 and bore 229 enables a certain amount of play between the drive body 204 and the slip gear 220, thereby providing a smoother feel to the mechanism 206. Additionally, in an attempt to further enhance the feel of the mechanism 206 and reduce the potential for unwanted drag or friction acting on the mechanism 206, in a preferred embodiment, the outer diameter of the slip gear 220 is selected to allow for a space between the outer periphery of the slip gear 220 and the interior surface of the housing 234, allowing the slip gear 220 to "float" within the housing 234, and not rub against the sides of the housing 234.

Referring now to FIGS. 3-8, to provide the torque level control for the mechanism 206, the fixed gear 218 and slip gear 220 are biased into engagement with the bearings 226 and one another by a number of biasing members or springs 232. The springs 232 can each be formed from any suitable biasing member or material, but are preferably formed as Belleville washers and are disposed within the housing 234. Each spring 232 is generally circular in shape with a central opening 235 through which the drive body 204 can extend and are disposed within the housing 234 against the fixed gear 218 opposite the slip gear 220. The springs 232 can be selectively compressed into engagement with one another and with the fixed gear 218 in order to provide the desired amount of force resisting the rotation of the gears 218, 220 and the bearings 226 with respect to one another during use of the tool 200.

In order to enable the force applied to the gears 218, 220 by the springs 232 to be varied as desired, an open end 235 of the housing 234 opposite the gripping portion 201 of the handle 202 is covered by a generally circular calibration nut 236 disposed around the drive body 204 in engagement with the springs 232 opposite the fixed gear 218. The calibration nut 236 preferably includes an expansion slot 237 that extends across the nut 236 and separates opposed portions 239 of the nut 236. The opposed portions 239 can be deflected away from one another and into engagement with the interior of the housing 234 to secure the nut 236 within the housing 234 and provide the desired force on the gears 218, 220 from the springs 232 by a tapered lock nut 238 also positioned around the drive body 204 and engaged between the body 204 and nut 236. To enable calibration nut 236 to be deflected, the nut 236, as well as the locking nut 238, is formed of a somewhat rigid material, such as a metal or hard plastic.

To utilize the calibration nut 236, the nut 236 is advanced into engagement with the springs 232 within the housing 234 until the desired spring force is exerted by the springs 232 against the gears 218, 220. In a preferred embodiment, the calibration nut 236 is advanced into the housing 234 by the engagement of exterior threads (not shown) on the nut 236 with interior threads (not shown) disposed on the interior of the housing 234. When the calibration nut 236 is positioned against the springs 232 at a location which provides the desired spring force to the gears 218, 220, the tapered lock nut 238 is engaged within the calibration nut 236 to urge the portions 239 of the nut 236 on opposite sides of the expansion slot 237 outwardly against the interior of the housing 234 and hold the calibration nut 236 in position. To further enhance the engagement of the calibration nut 236 with the housing 234, the nut 236 can include a number of a outwardly extending drive tangs (not shown) disposed on the exterior of the calibration nut 236 that engage the threads on the interior of the housing 234 in a manner to further prevent movement of the nut 236 with respect to the housing 234.

Looking now at FIGS. 5-8, to reduce any drag exerted by the inner housing 234 on the rotation of the slip gear 220, and to ensure that the force acting on the gears 218, 220 is limited as much as possible to only the force of the springs 232, the slip gear 220 is isolated from the inner end of the housing 234 by a hardened washer 241 and thrust bearing 240. The thrust bearing 240 includes roller bearings 242 therein that rotate within the thrust bearing 240 and contact the slip gear 220 to enable the slip gear 220 to rotate easily within the housing 234. A hardened washer 243 is also positioned between the springs 232 and the fixed gear 218 to enhance the frictional contact between the fixed gear 218 and the springs 232.

Look now at FIGS. 3-5 and 7, the interior components of the mechanism 206 described previously are enclosed within the housing 234 of the tool 200 by a generally cylindrical cover 244 that is releasably engaged with the exterior of the housing 234, such as by mating threads 344 on the exterior of the housing 234 and the interior of the cap 244. The cap 244 can be quickly and easily removed from the handle 202 in order to expose the mechanism 206 and enable the easy adjustment, service and/or replacement of any parts of the mechanism 206. The cover 244 defines a central opening 245 at an outer end thereof that receives an access cap 246 releasably secured to the cover 244 within the opening 245 around the drive body 204. The access cap 246 is fixed to the cover 244 by any suitable means in order to prevent the rotation of the cover 244 with respect to the housing 234, thereby preventing the inadvertent detachment of the cover 244 from the handle 202, such as during use of the tool 200. Preferably a number of fasteners (not shown) are engaged within bores 247 in the cap 246 to deflect the cap 246 into engagement with the cover 244 around the opening 245. The access cap 246 includes an O-ring 248 disposed around an inner opening 249 of the cap 246 that sealingly engages, but does not impede the rotation of the drive body 204 within the cap 246, in order to seal off the interior of the cover 244 and prevent the mechanism 206 from encountering any water, dust or other debris which can negatively affect the operation of the mechanism 206. A similar O-ring 250 can be disposed on the inner end of the drive body 204 located within the handle 202 to effectively seal the interior of the tool 200 to protect the components of the mechanism 206.

Other alternatives to the preferred embodiment described previously can be formed by changing the orientation of the fixed gear 218, slip gear 220 and springs 232 from the order of these components shown in the drawing Figs. Also, the location of the calibration nut 236 can also be altered depending upon the location of the springs 232, or can be positioned to engage the gears 218, 220 instead of the springs 232. Further, the bearing members 226 can be other than ball bearings, such as pin bearings, with corresponding changes to the shape of the dimples 225, 228 in the respective gears 218, 220. Additionally, the housing 234 can be formed separately from the handle 202 while the cover 244 can be formed as part of the handle 202.

In addition, in order to further provide a tool 200 with the ability to control the torque applied using the tool 200, a second embodiment of the torque-limiting mechanism 306 for use in a tool 200 is illustrated in FIGS. 22-35. In this mechanism 306, a fixed gear 318 and a slip gear 320 that provide the torque-limiting function to the mechanism 306 are formed of a rigid material and positioned adjacent to one another as described previously with regard to mechanism 206. The fixed gear 318 includes a number of dimples 325 spaced around a central opening 327 in the gear 318 on one surface of the fixed gear 318. The opening 327 can be cylindrical or can define an annular shoulder 327' therein to assist in the formation of the dimples 325. A number of spherical ball bearings 326 are disposed within the dimples 325 and are able to rotate therein. The depth of the dimples 325 in the gear 318 are preferably sufficient to receive approximately one-half of the volume of each bearing 326 such that while the bearings 326 can rotate within the dimples 325, the bearings 326 are each maintained within the dimples 325. In a particularly preferred embodiment, the bearings 326, which are formed of a rigid and smooth material, such as a metal, formed to have a diameter slightly less than the diameter of the dimples 325. This allows the bearing 326 to rotate more freely within the dimples 325 when the mechanism 306 is in use. The gear 318 also preferably includes a pair of flats 352 formed on opposite sides of the gear 318 that are engageable with the tool housing 234 to maintain the position of the gear 318 within the housing.

The rotatable or slip gear 320 is formed similarly to the fixed gear 318 with a central opening 327 and a number of dimples 328 spaced around the opening 327 on one side of the gear 320 that are positioned to face the dimples 325 in the fixed gear 318. The dimples 328 receive the end of each of the bearings 326 extending outwardly from the dimples 325 in the fixed gear 318, but are less deep than the dimples 325 in the fixed gear 318. The slip gear 320 also includes an arcuate raceway 330 extending around the surface of the gear 320 along a circular centerline between the dimples 328. During operation of the mechanism 306, the bearings 326, while retained in dimples 325 on the fixed gear 318, can move along the raceway 330 in order to displace the bearings 326 between the respective dimples 328 on the slip gear 320 as the slip gear 320 rotates with respect to the fixed gear 318 when a torque level above a pre-selected maximum as applied to the tool 200.

Figure 23:
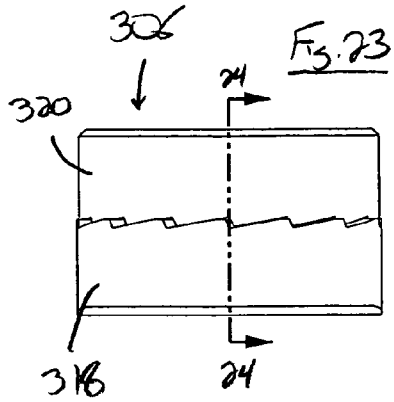
FIG. 23 is a side plan view of the mechanism of FIG. 22.
Figure 27:
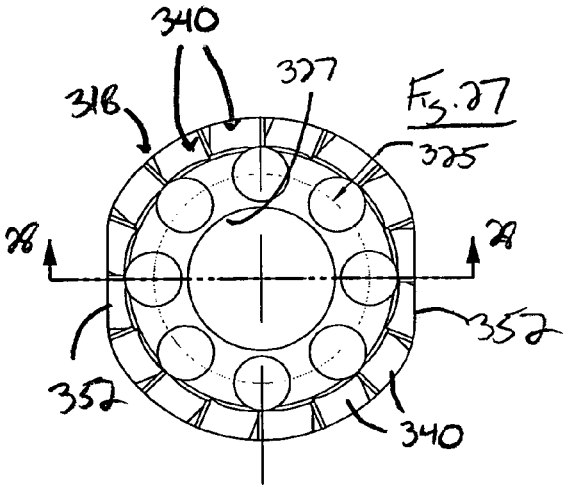
FIG. 27 is a top plan view of the fixed gear of FIG. 25.
Figure 29:
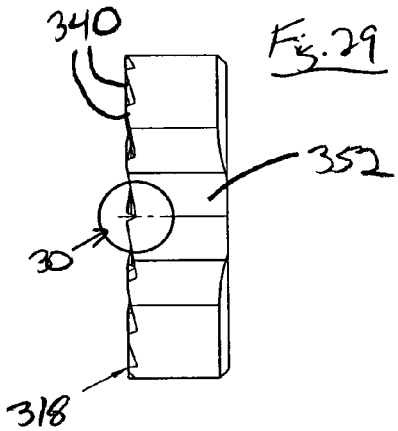
FIG. 29 is a side plan view of fixed gear of FIG. 25.
Figure 28:
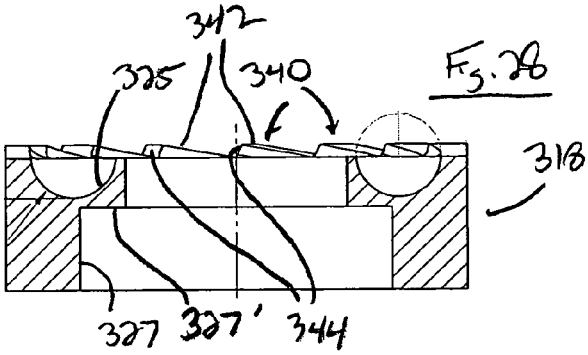
FIG. 28 is a cross-sectional view along line 28-28 of FIG. 27.
Figure 30:
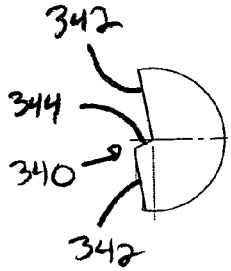
FIG. 30 is a partially broken away side plan view of a tooth of the fixed gear of FIG. 29.
Figure 34:
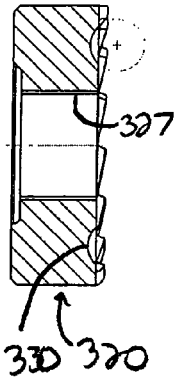
FIG. 34 is a cross-sectional view along line 34-34 of FIG. 33.
Figure 33:
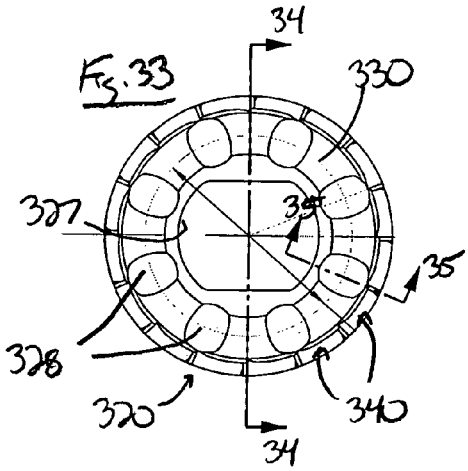
FIG. 33 is a top plan view of the slip gear of FIG. 31.
Figure 31:
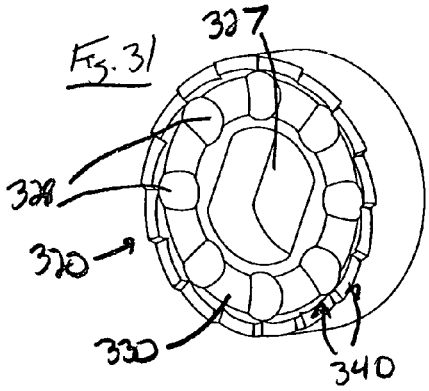
FIG. 31 is an isometric front view of a slip gear of the mechanism of FIG. 22.
Figure 32:
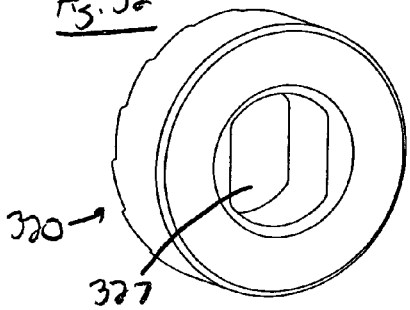
FIG. 32 is an isometric rear view of the slip gear of FIG. 31
Figure 37:
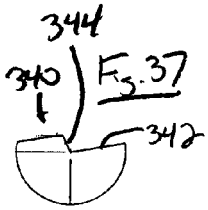
FIG. 37 is a partially broken away side plan view of a tooth on the slip gear of FIG. 36.
Figure 36:
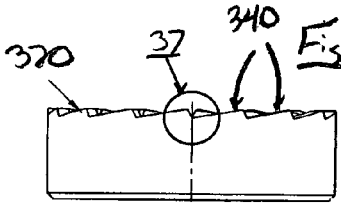
FIG. 36 is a side plan view of the slip gear of FIG. 31.
Figure 25:
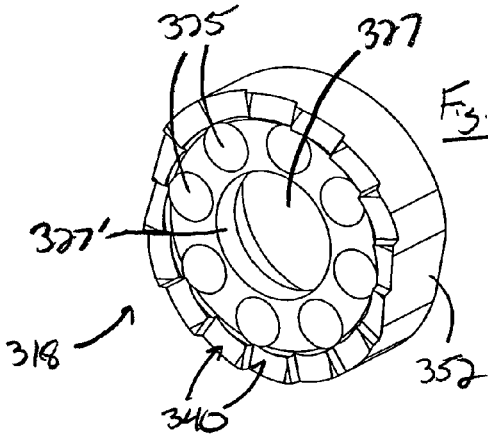
FIG. 25 is an isometric front view of a fixed gear of the mechanism of FIG. 22.
Figure 35:
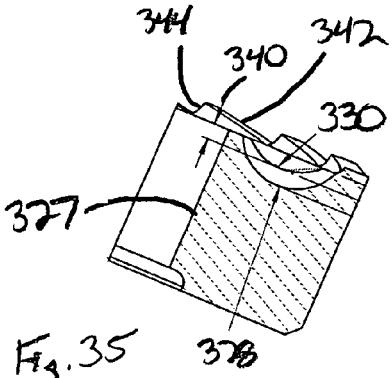
FIG. 35 is a cross-sectional view along line 35-35 of FIG. 33.
Figure 26:
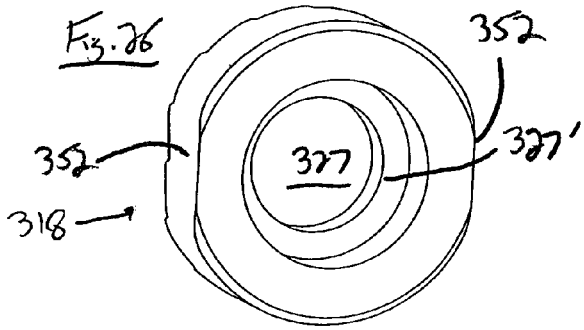
FIG. 26 is an isometric rear view of the fixed gear of FIG. 25.

In order to provide additional resistance control to the movement of the slip gear 320 with regard to the fixed gear 318, each of the fixed gear 318 and the slip gear 320 includes teeth 340 positioned on the outer periphery of the gears 318 and 320. The teeth 340 are spaced equidistant from one another around the periphery of each gear 318 and 320 in a form so as to be positioned in a locking engagement when the gears 318 and 320 are assembled, as best shown in FIG. 23. In this configuration, the teeth 340, which each include a sloped friction surface 342 and a locking surface 344, oppose the rotation of the slip gear 320 with regard to the fixed gear 318 by the frictional engagement of the sloped surfaces 342 and vertical surfaces 344 of each of the teeth 340. However, as opposed to prior art gears 100, 101, the locking surfaces 344 of the teeth 340 are formed to be inclined from the vertical at an angle of between ten degrees (10°) to twenty-five degrees (25°), and preferably around fifteen degrees (15°), similar to the angle for the friction surfaces 342 from the horizontal. The angle of the locking surfaces 344 allow the teeth 340 to slip more easily with regard to one another and prevent the snapping and vibrations caused by the shape of the teeth 102 in prior art gears 100, 101.

Additionally, the formation of the teeth 340 including the locking surface 344 on each of the gears 318 and 320 provides a one-way rotational or ratcheting function for the mechanism 306. In other words, due to the positioning of the locking surfaces 344 on each gear 318 and 320, when the slip gear 320 is rotated in a direction which contacts locking surfaces 344 of teeth 340 on each gear 318 and 320 with one another, the contact between the locking surfaces 344 prevents any further rotation of the slip gear 320 in this direction. However, rotation in the direction moving the locking surfaces 344 away from one another is permitted by the construction of the mechanism 306.

In an additional variation to the construction of the gears 318 and 320, it is possible to vary depth of dimples 325 and/or 328 to vary the amount of torque provided by the friction generated between the gears 318 and 320 and the bearings 326 without changing biasing or spring pressure provided by the particular springs 232 being utilized in the tool 200.

Further, as an alternative to the lock nut 238, it is possible to drill a hole (not shown) into the side of the housing 234 and insert therein a pin (not shown) through the side of the housing 234 to engage the calibration nut 236.

Various additional alternatives are contemplated as being within the scope of the following claims particularly pointing out and distinctly claiming the subject matter regarded as the invention.

We hereby claim:

1. A torque-limiting mechanism for a tool, the mechanism comprising:

a) a first gear including a number of first recesses and a number of first teeth;

b) a second gear disposed adjacent the first gear and including a number of second recesses a number of second teeth engageable with the first teeth;

c) a number of bearings disposed between the first gear and the second gear partially within the first recesses and partially within the second recesses; and d) a variable force-applying assembly engaged with the first gear opposite the second gear, wherein the depth of either the number of first recesses or the number of second recesses is approximately equal to one half of the volume of the bearings to retain the bearings therein, and wherein one of the first gear or the second gear includes a pair of flat surfaces disposed on opposite sides of the one of the first gear or the second gear that are adapted to engage a housing for the tool to retain the one of the first gear or the second gear stationary with respect to the housing.

2. The mechanism of claim 1, wherein each of the first teeth includes a sloped friction surface, and a non-vertical locking surface.

3. The mechanism of claim 2, wherein each of the second teeth includes a sloped friction surface, and a non-vertical locking surface.

4. The mechanism of claim 2 wherein the sloped friction surface of each tooth is oriented at an angle of between ten degrees and twenty-five degrees with respect to parallel to an exterior face of the first gear.

5. The mechanism of claim 2 wherein the non-vertical locking surface is oriented at an angle of between ten degrees and twenty-five degrees with respect to perpendicular of the face of the first gear.

6. The mechanism of claim 5 wherein the non-vertical locking surface is oriented at an angle of about fifteen degrees with respect to perpendicular of the face of the first gear.

7. A tool for driving a fastener, the tool comprising:

a) a housing including a closed end and an open end;

b) a drive body extending outwardly from the housing through the open end;

c) a first gear secured to the housing and including a number of first recesses and a number of first teeth;

d) a second gear secured to the drive body within the housing adjacent the first gear and including a number of second recesses and a number of second teeth engageable with the first teeth;

e) a number of bearings positioned between the first gear and the second gear within the first recesses and the second recesses; and f) an adjustable force-applying assembly engaged with the one of the first gear or the second gear, wherein the depth of either the number of first recesses or the number of second recesses is sufficient to effectively retain the bearings therein, and wherein one of the first gear or the second gear includes a pair of flat surfaces disposed on opposite sides of the one of the first gear or the second gear that are adapted to engage a housing for the tool to retain the one of the first gear or the second gear stationary with respect to the housing.

8. The mechanism of claim 7, wherein each of the first teeth includes a sloped friction surface, and a non-vertical locking surface.

9. The mechanism of claim 8, wherein each of the second teeth includes a sloped friction surface, and a non-vertical locking surface.

10. The mechanism of claim 8 wherein the sloped friction surface of each tooth is oriented at an angle of between ten degrees and twenty-five degrees with respect to parallel to an exterior face of the first gear.

11. The mechanism of claim 8 wherein the non-vertical locking surface is oriented at an angle of between ten degrees and twenty-five degrees with respect to perpendicular of the face of the first gear.

12. The mechanism of claim 11 wherein the non-vertical locking surface is oriented at an angle of about fifteen degrees with respect to perpendicular of the face of the first gear.

13. The mechanism of claim 7 wherein the first teeth are disposed in a first peripheral ring around the first recesses in the first gear.

14. A method for adjusting the maximum torque to be applied by a tool including a torque-limiting mechanism, the method comprising the steps of:

a) providing a tool including a housing having a closed end and an open end, a drive body extending outwardly from the housing through the open end, a first gear secured to the housing and including a number of first recesses and a number of first teeth, a second gear secured to the drive body adjacent the first gear and including a number of second recesses a number of second teeth engageable with the first teeth, a number of bearings positioned between the first gear and the second gear and partially within the first recesses and the second recesses, and an adjustable force-applying assembly engaged with one of the first gear or the second gear and including a number of force-applying members and an adjustable securing member, wherein the depth of either the number of first recesses or the number of second recesses is approximately equal to one half of the volume of the bearings to retain the bearings therein, and wherein one of the first gear or the second gear includes a pair of flat surfaces disposed on opposite sides of the one of the first gear or the second gear that are adapted to engage a housing for the tool to retain the one of the first gear or the second gear stationary with respect to the housing; and b) adjusting the position of the securing member with respect to the housing to compress the force-applying members into engagement with one of the first gear or the second gear.

* * * * *